US010888737B1

(12) United States Patent
Sahakyan

(10) Patent No.: US 10,888,737 B1
(45) Date of Patent: Jan. 12, 2021

(54) CONFIGURABLE FOOTWEAR FOR WATER SPORTS

(71) Applicant: Artak Sahakyan, South Chatham, MA (US)

(72) Inventor: Artak Sahakyan, South Chatham, MA (US)

( * ) Notice: Subject to any disclaimer, the term of this patent is extended or adjusted under 35 U.S.C. 154(b) by 0 days.

(21) Appl. No.: 16/447,552

(22) Filed: Jun. 20, 2019

(51) Int. Cl.
*A63B 31/11* (2006.01)
*A43B 5/08* (2006.01)

(52) U.S. Cl.
CPC ..... *A63B 31/11* (2013.01); *A43B 5/08* (2013.01); *A63B 2031/112* (2013.01)

(58) Field of Classification Search
CPC ..... A63B 31/11; A63B 2031/112; A43B 5/08
See application file for complete search history.

(56) References Cited

U.S. PATENT DOCUMENTS 3,268,927 A * 8/1966 Markowitz ..... A63B 31/12 441/63
4,981,454 A * 1/1991 Klein ..... A63B 31/11 441/62
5,108,327 A * 4/1992 Klein ..... A63B 31/11 441/62
5,632,662 A * 5/1997 Cadorette ..... A63B 31/11 441/63
5,820,428 A * 10/1998 Stadler ..... A63B 31/11 441/64
6,126,502 A * 10/2000 Hull ..... A63B 31/11 441/63
6,672,920 B2 * 1/2004 Wilson ..... A63B 31/11 441/64
7,134,927 B1 * 11/2006 Johnson ..... A63B 31/11 441/64
7,140,937 B2 * 11/2006 Cadorette ..... A43B 5/08 441/64
7,470,937 B2 * 12/2008 Yasui ..... G02B 6/4201 257/664
9,433,825 B1 * 9/2016 Nguyen ..... A63B 31/11
2016/0243405 A1 * 8/2016 Herring ..... A63B 31/11
2017/0007888 A1 * 1/2017 Stroud ..... A63B 31/11
2019/0336829 A1 * 11/2019 de Grasse ..... A63B 31/11

* cited by examiner

*Primary Examiner* — Anthony D Wiest
(74) *Attorney, Agent, or Firm* — Intrinsic Law Corp.

(57) ABSTRACT

A configurable wearable apparatus for water sports includes a boot and a fin pivotably attached to the boot. In a first configuration, the fin is oriented towards the toe portion of the boot. In a second configuration, the fin is oriented towards the heel portion of the boot. The fin can be attached to the boot by rods having first and second ends. The first end of each rod is attached to the fin and the second end of each rod is attached to a pivot point on the side of the boot. The second end of the rods can be releasably secured to the toe portion or to the heel portion of the boot with press-fit or friction-fit assemblies.

5 Claims, 13 Drawing Sheets

CONFIGURABLE FOOTWEAR FOR WATER SPORTS

TECHNICAL FIELD

The present application relates generally to fins worn on a user's feet for water sports and similar activities.

BACKGROUND

Existing swim fins include a receptacle for a user's foot and a fin that extends from the toe portion of the receptacle. The relative position of the fin with respect to the receptacle is fixed. When the user wears such swim fins out of the water, it is difficult to walk or dangerous because the fin impedes the foot's motion. For example, persons who SCUBA dive from platforms or boats are instructed to walk sideways or backwards when wearing swim fins to avoid tripping. But these methods of walking are themselves hazardous and awkward.

Also, existing water sport footwear are not flexible for use in multiple situations or depending on a user's preferences. For example, a user cannot determine a configuration of his or her footwear during use. Aesthetic and functional variations are not achievable with a same set of existing swim fins or water sport foot gear.

It would be desirable to overcome these and/or other problems with conventional swim fins.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

An aspect of the invention is directed to an apparatus for water sports, comprising: a boot having a toe portion and a heel portion; and a fin pivotably attached to the boot, wherein: in a first configuration the fin is oriented towards the toe portion, and in a second configuration the fin is oriented towards the heel portion.

In one or more embodiments, the fin is releasably secured in the first and second configurations. In one or more embodiments, the apparatus further comprises first and second rods, each rod comprising a first end that is pivotably attached to a respective side of the boot and a second end that is (a) attached to the fin and (b) releasably attached to the respective side of the boot. In one or more embodiments, a first cavity is defined at the toe portion on each side of the boot, the second end of each rod includes a body, and each first cavity is configured to releasably secure the body to place the apparatus in the first configuration. In one or more embodiments, a second cavity is defined at the heel portion on each side of the boot, and each second cavity is configured to releasably secure the body to place the apparatus in the second configuration. In one or more embodiments, the first end of each rod is coupled to a bearing.

Another aspect of the invention is directed to an assembly for water sports, comprising: a first apparatus; and a second apparatus, wherein each of the first and second apparatus comprises: a boot having a heel portion and a toe portion; and a fin pivotably attached to the boot, wherein: in a first configuration the fin is disposed adjacent to or oriented towards the toe portion, and in a second configuration the fin is disposed adjacent to or oriented towards the heel portion.

In one or more embodiments, the assembly further comprises a tether attached to the first and second apparatus. In one or more embodiments, the tether comprises a stretchable fabric, an elastic, and/or a mesh. In one or more embodiments, the tether is attached to each fin. In one or more embodiments, wherein the tether is attached to each boot.

Another aspect of the invention is directed to a method of configuring an apparatus for water sports, comprising: applying a first force to a second end of a rod to releasably secure the second end of a rod in a first press-fit assembly disposed at a toe portion on a side of a boot, the second end attached to a fin; applying a second force to the second end of the rod to release the second end of the rod from the first press-fit assembly, the second force in an opposite direction to the first force; pivoting the rod about a first end of the rod such that the second end of the rod is disposed proximal to a heel portion on the side of the boot; applying a third force to the second end of the rod to releasably secure the second end of the rod in a second press-fit assembly disposed at the heel portion; and changing an orientation of the fin from a first orientation where the fin is oriented towards the toe portion of the boot to a second orientation where the fin is oriented towards the heel portion of the boot.

In one or more embodiments, the first press-fit assembly comprises a body disposed on the second end of the rod and a first cavity defined in the toe portion on the side of the boot. In one or more embodiments, the second press-fit assembly comprises the body a second cavity defined in the heel portion on the side of the boot.

In another embodiment, a pin, rod or securement member is disposed on one or both sides of the fin. These are secured to rigid mechanically mating members on the respective side(s) of the boot. The securement of the mating members on the fin and boot are accomplished as above, e.g., using pressure fit, friction fit, snaps, latches, hooks, bolts, or other mechanical mating components so that the set of securement members on the fins are mated to and secured into corresponding complementary set of securement members on the boot and hold the fin in the desired configuration (e.g., pointed forwards or backwards).

BRIEF DESCRIPTION OF THE DRAWINGS

For a fuller understanding of the nature and advantages of the present concepts, reference is made to the following detailed description of preferred embodiments and in connection with the accompanying drawings.

DETAILED DESCRIPTION

A fin is pivotably attached to a swim boot such that the fin can be disposed in front of the boot's toe portion or behind the boot's heel portion. The fin is attached to a second end of rods that extend to a first end at pivot points disposed on the each side of the boot. The second end of each rod can be releasably secured to the toe portion and to the heel portion of the boot with corresponding press-fit assemblies. Each press-fit assembly includes a cavity defined in the boot (e.g., front and rear activities) and a body disposed on the second end of the rod, which can be press-fit into the desired cavity.

In the first configuration, the fin is disposed in front of the toe portion. This configuration can be useful for swimming, snorkeling, scuba diving, and/or body surfing. In the second configuration, the fin is disposed behind of the heel portion such that the fin does not impede the user's ability to walk flat-footed. This configuration can be useful for walking, waterskiing, and/or surfing.

Figure 1A:
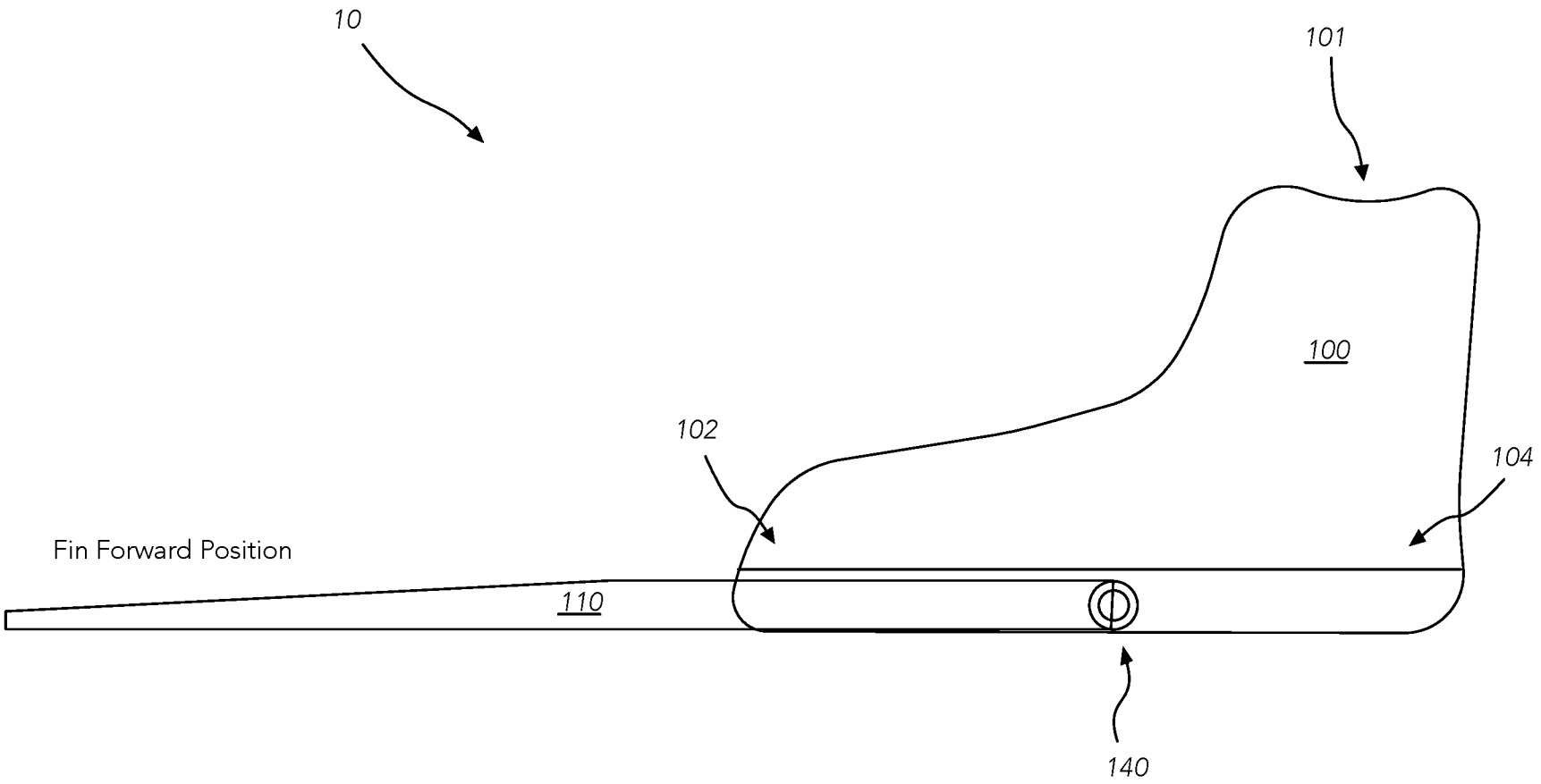
FIGS. 1A and 1B are side and top views of a wearable apparatus for water sports in a first (Fin Forward) configuration.
Figure 1B:
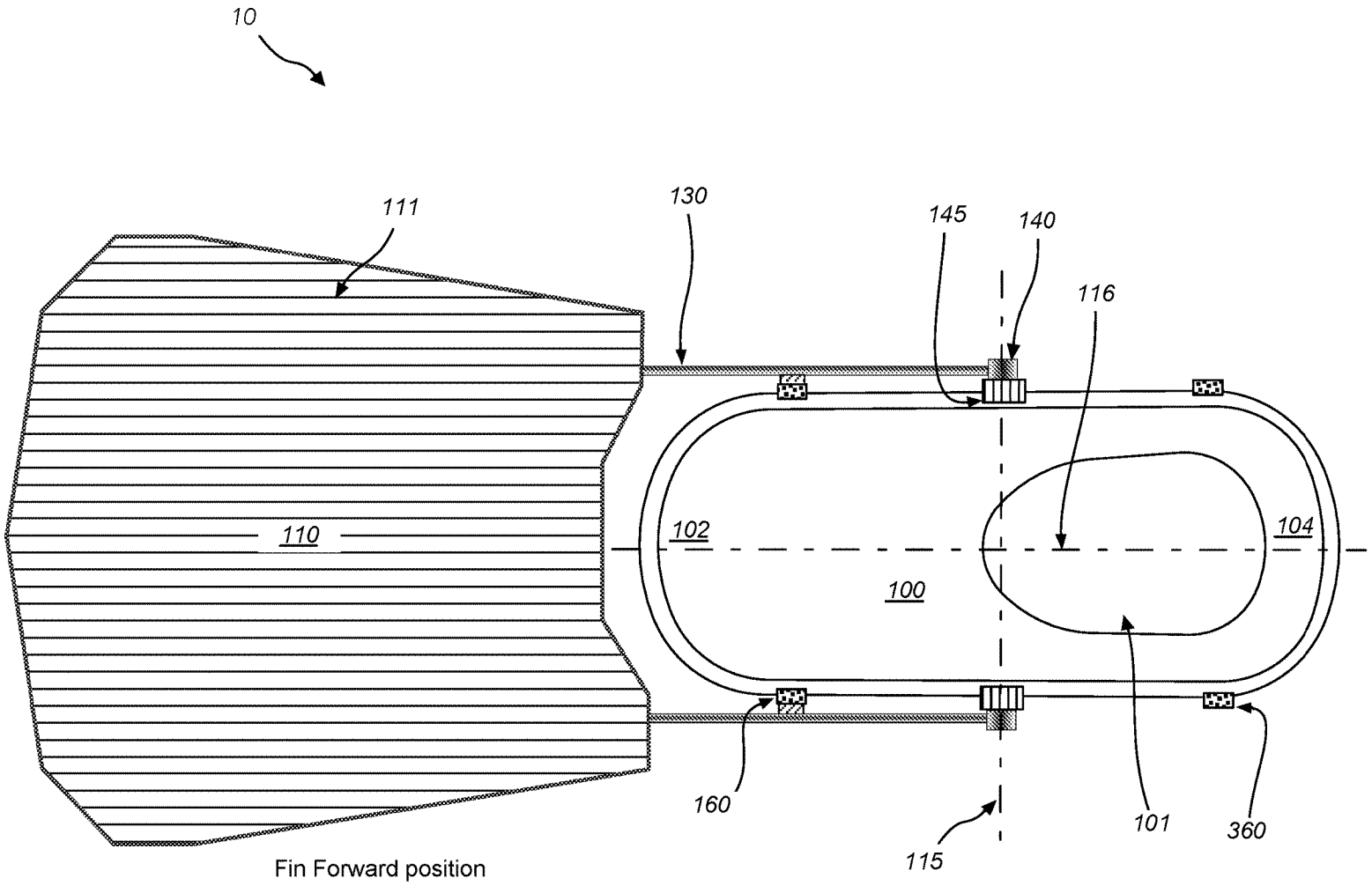

FIGS. 1A and 1B illustrate a water sport foot-worn apparatus 10 generally comprising a boot, shoe or other wearable portion 100 to be worn on a user's foot and into which the user's foot can be placed, e.g., into footwell 101. The boot or shoe 100 can then be secured to the foot with laces, snaps, zippers, hook-and-loop, elastic or other mechanical securing means to keep it securely worn during use. The apparatus 10 also generally comprises a fin 110 that acts to move water about on account of its size and shape and surface area 111, and to provide corresponding thrust or other hydro dynamics and forces at the foot of the user during use. Such uses as explained may include swimming, snorkeling, water skiing, scuba diving, and/or body surfing, or generally for water sport activities. The present invention provides for an articulated fin 110 that pivots on demand about a pivot point or bearing 140 coupled to the boot or shoe portion 100.

The fin 110 may be connected to the boot 100 by one or more connecting rods 130, which may be molded into, fastened to or otherwise mechanically coupled to the body of fin 110 at one end, and coupled to a pivot point 140 at the other end as shown. The pivot point of the fin connecting rod is made to rotate about an axis 115 running transverse to the toe-heel axis 116 of the user's foot. A bearing or pivoting member 145 allows the fin 110 and connecting rods 130 to swing about the axis 115 to change the orientation of the fin from a Fin Forward (first state) to a Fin Rearward (second state) as will be explained further below. When in use in the first and second states or configurations (forward or backward respectively), the fin 110 and connecting rods 130 are secured in place at forward and rear locking points 160 and 360 respectively.

Figure 2A:
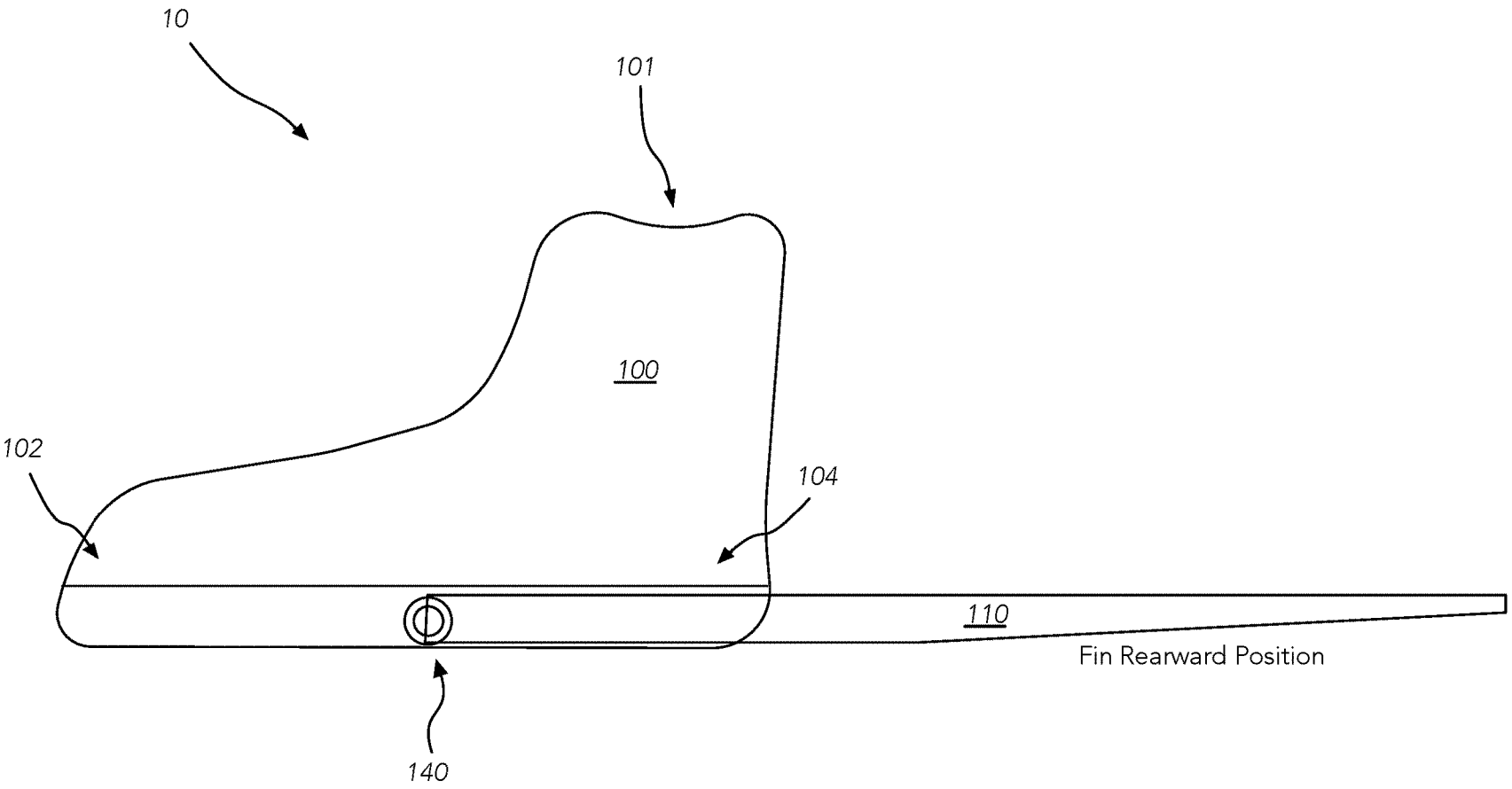
FIGS. 2A and 2B are side and top views of a wearable apparatus for water sports in a second (Fin Rearward) configuration.
Figure 2B:
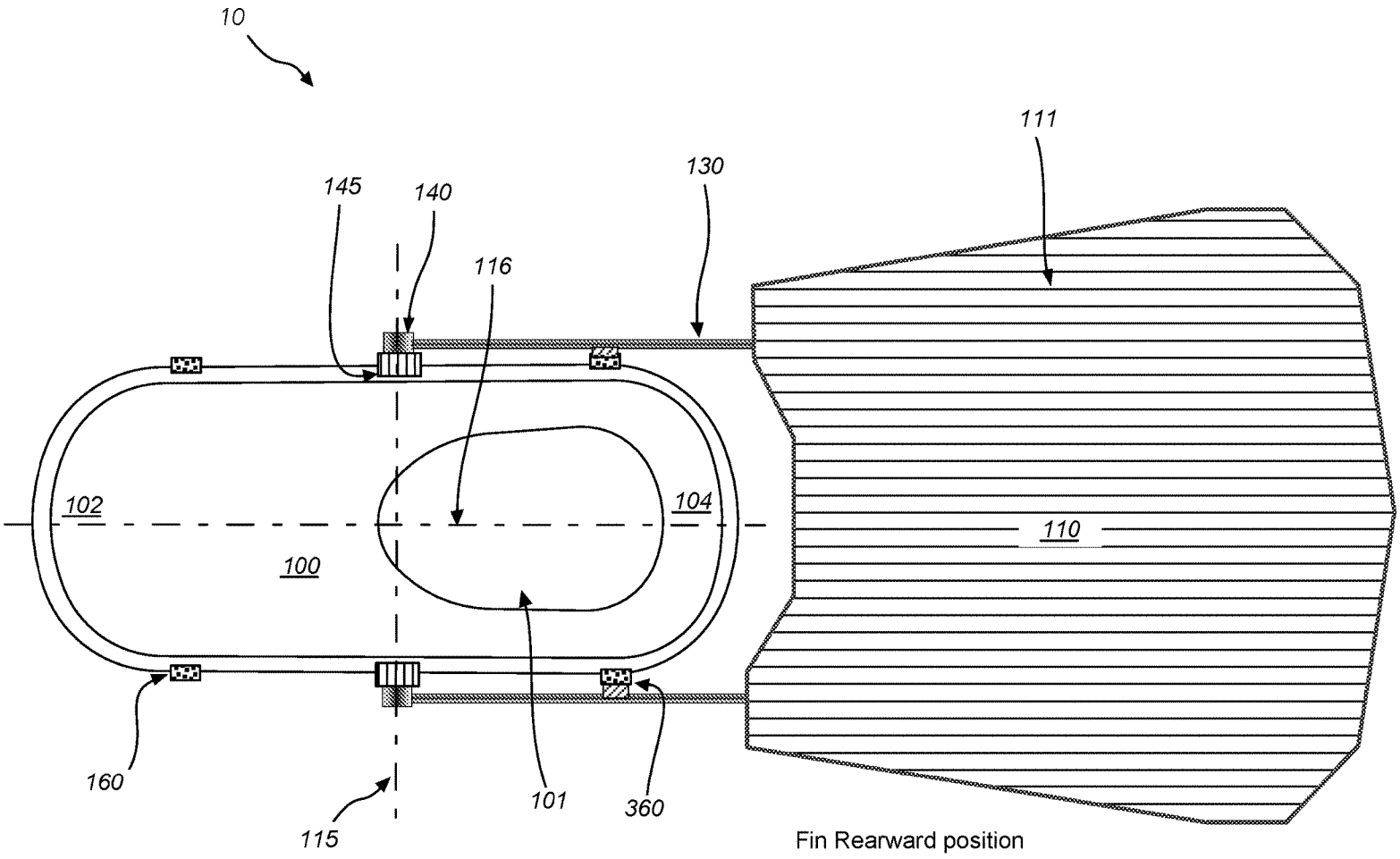

FIGS. 2A and 2B illustrate the apparatus 10 upon pivoting backwards or to the rear of the user so that the fin 110 is pointed towards the heel portion 104 of the boot 100. The user can thus selectably swing the fin 110 in a first state to point forwards (Fin Forward Position) during certain activities such as swimming or diving, or in a second state to point rearwards (Fin Rearward Position) during certain activities such as resting or walking on dry land. The uses mentioned are exemplary and not limiting, and users can selectively decide when and how to employ the device in the two states.

Figure 3:
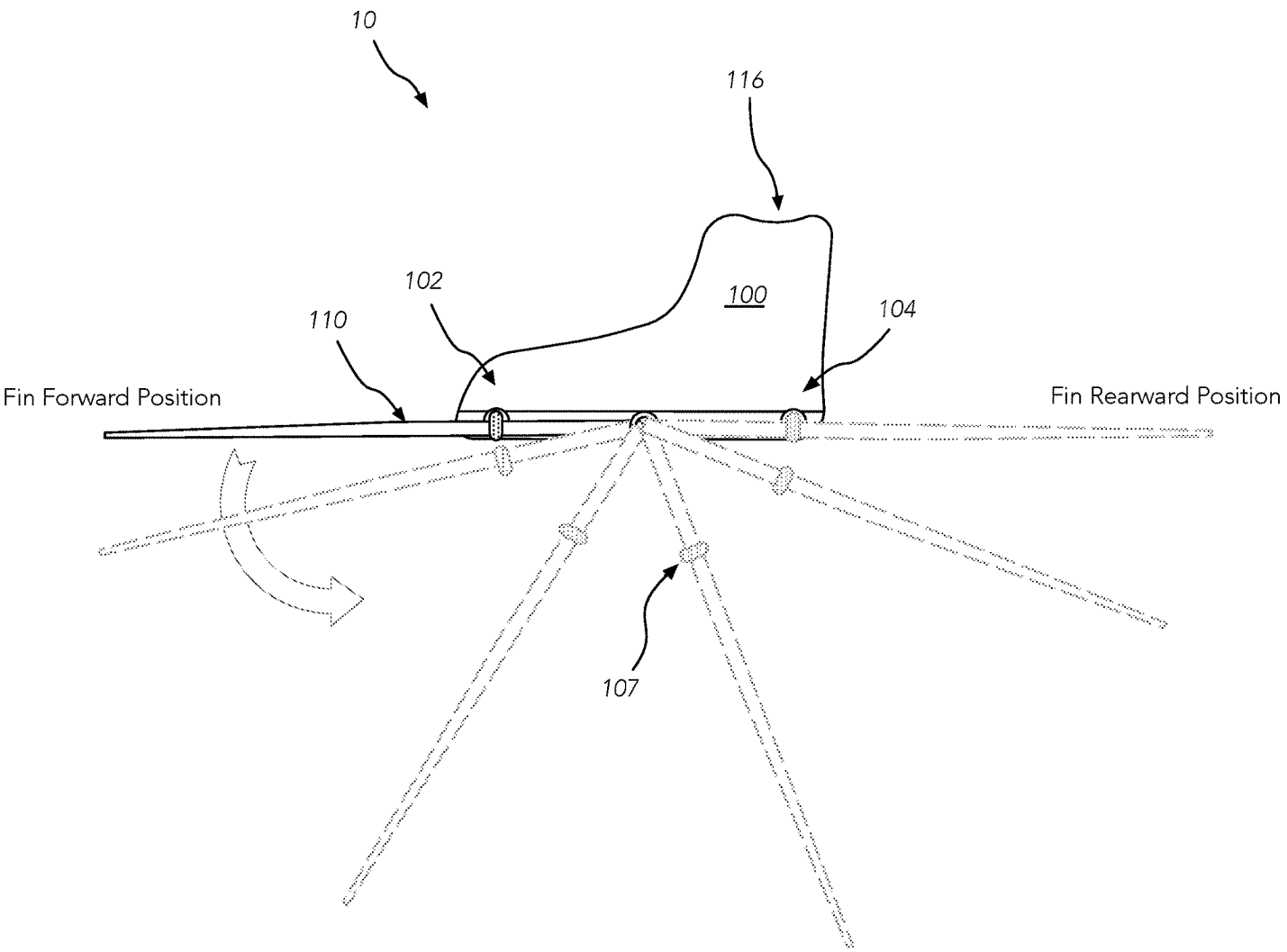
FIG. 3 illustrates an optional cross-bar connection design.

FIG. 3 illustrates conceptually how the fin 110 would be rotated from a first state or configuration (Fin Forward) to a second state or configuration (Fin Rearward) so that the fin 110 is directed towards the toe 102 or heel 104 for different uses. To lock or secure the fin 110 into a Forward or Backward position, a securement body 107 (or an opposing pair of securement bodies 107, one on either side of the user's foot) can snap into or lock into a receiving locking point 102, 104 respectively.

Figure 4:
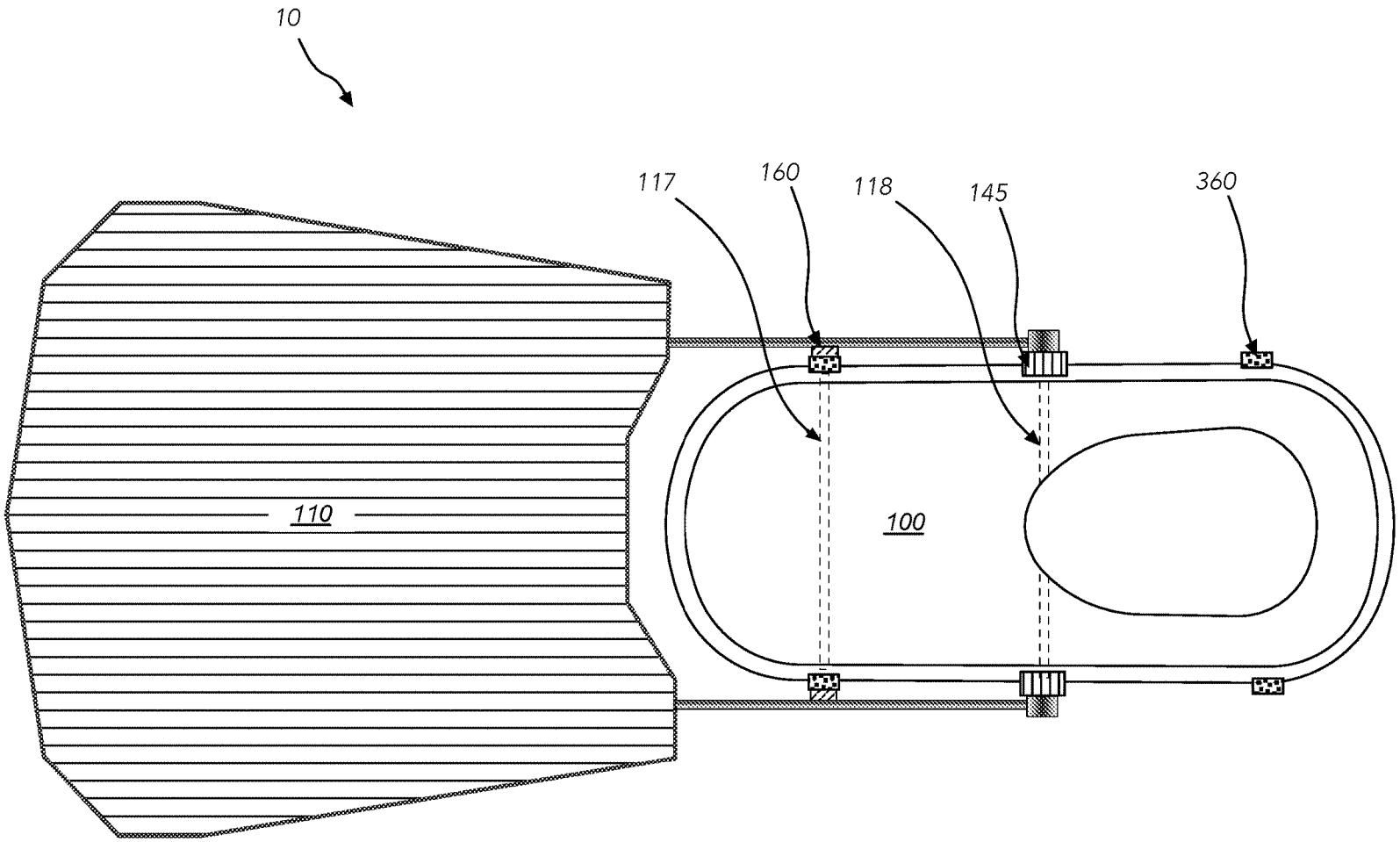
FIG. 4 illustrates a conceptual rotation of a water sport fin in its apparatus to change from a first to a second state or configuration.

FIG. 4 illustrates the present apparatus 10, additionally showing how the apparatus may comprise pivoting cross-bars, including a cross-bar 117 that configurably swings into the Fin Forward position to lock into corresponding forward locking points 160 on either side of boot 100, or rearward to lock into Fin Rearward position locking points 360. Cross-bar 118 may provide structural rigidity and connect between the bearing or pivot points 145 on either side of boot 100. One or more of the cross-bars 117, 118 are optional in certain embodiments, and the apparatus 10 can be designed and operated without these cross-bars in other embodiments.

Figure 5A:
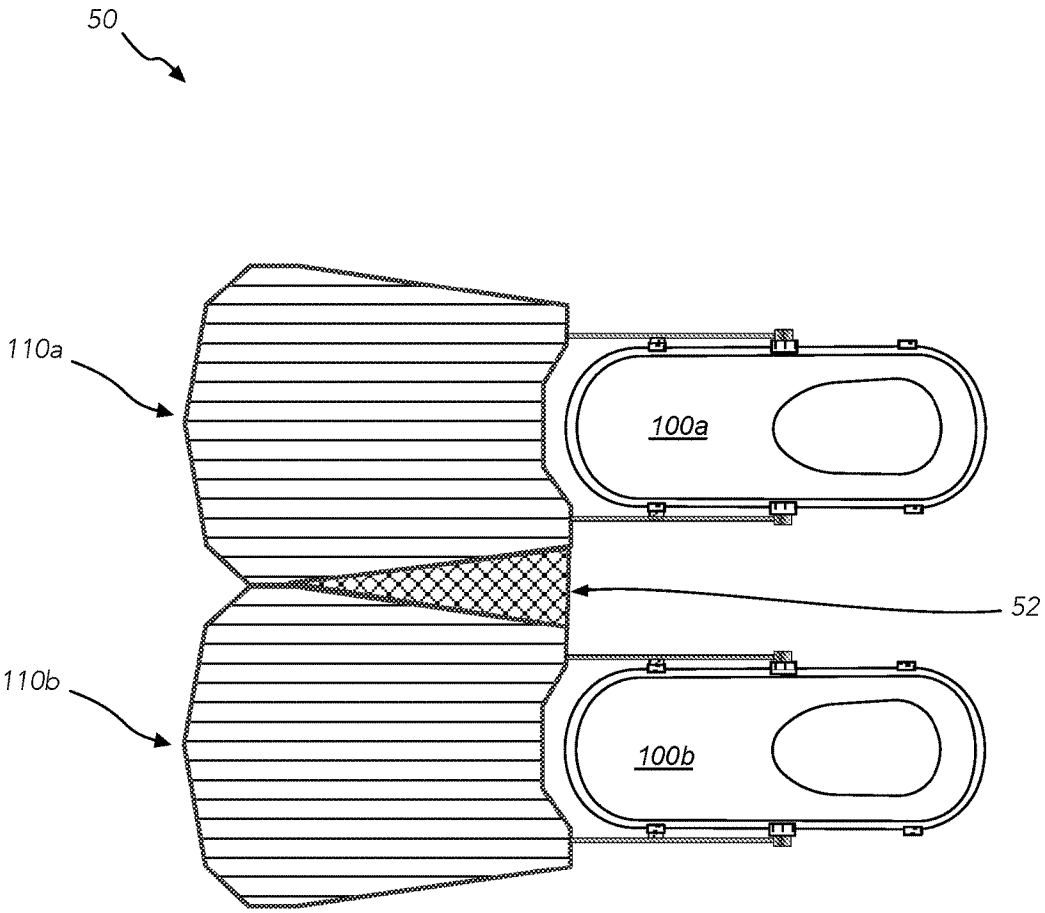
FIG. 5A illustrates a coupled, paired or tethered fin apparatus.
Figure 5B:
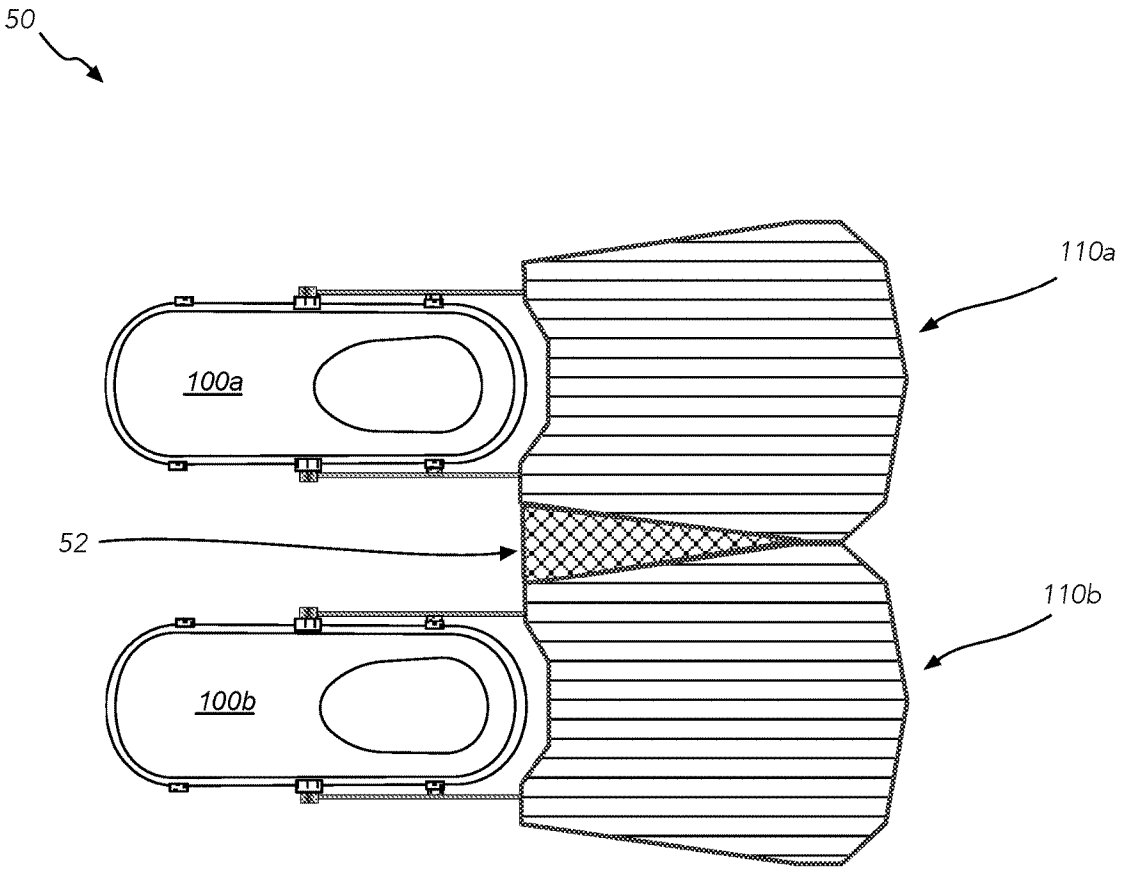
FIG. 5B illustrates the apparatus of the preceding figure in its backwards-facing position.

FIG. 5A illustrates a coupled swim fin wearable water sport apparatus 50. The apparatus comprises a pair of wearable foot gear or boots 100*a* and 100*b* to be worn on the user's feet. This drawing illustrates the apparatus in its forward or toe-facing position. The apparatus also comprises a pair of fins 110*a* and 110*b*, each coupled to a respective boot 100*a*, 100*b* as described earlier. The apparatus 50 is further configured with a tethering or connecting material 52 disposed between the fins 110*a* and 110*b* such that the fins are mechanically coupled to one another and so that they will generally move together. For instance, the user can swim by undulating both of his or her feet in unison or in phase with one another (rather than out of phase) to achieve a certain style of swimming or diving motion. The coupling material 52 can include a stretchable fabric, netting, hook and loop material, an elastic material, and/or a mesh. The tether material 52 can be attached to the fins 110*a*, 110*b* to encourage or to allow the user to swim using a dolphin kick for example. The fins 110*a*, 110*b* can be locked in a Fin Forward or in a Fin Backward configuration as described above, shown in FIG. 5B.

Figure 6:
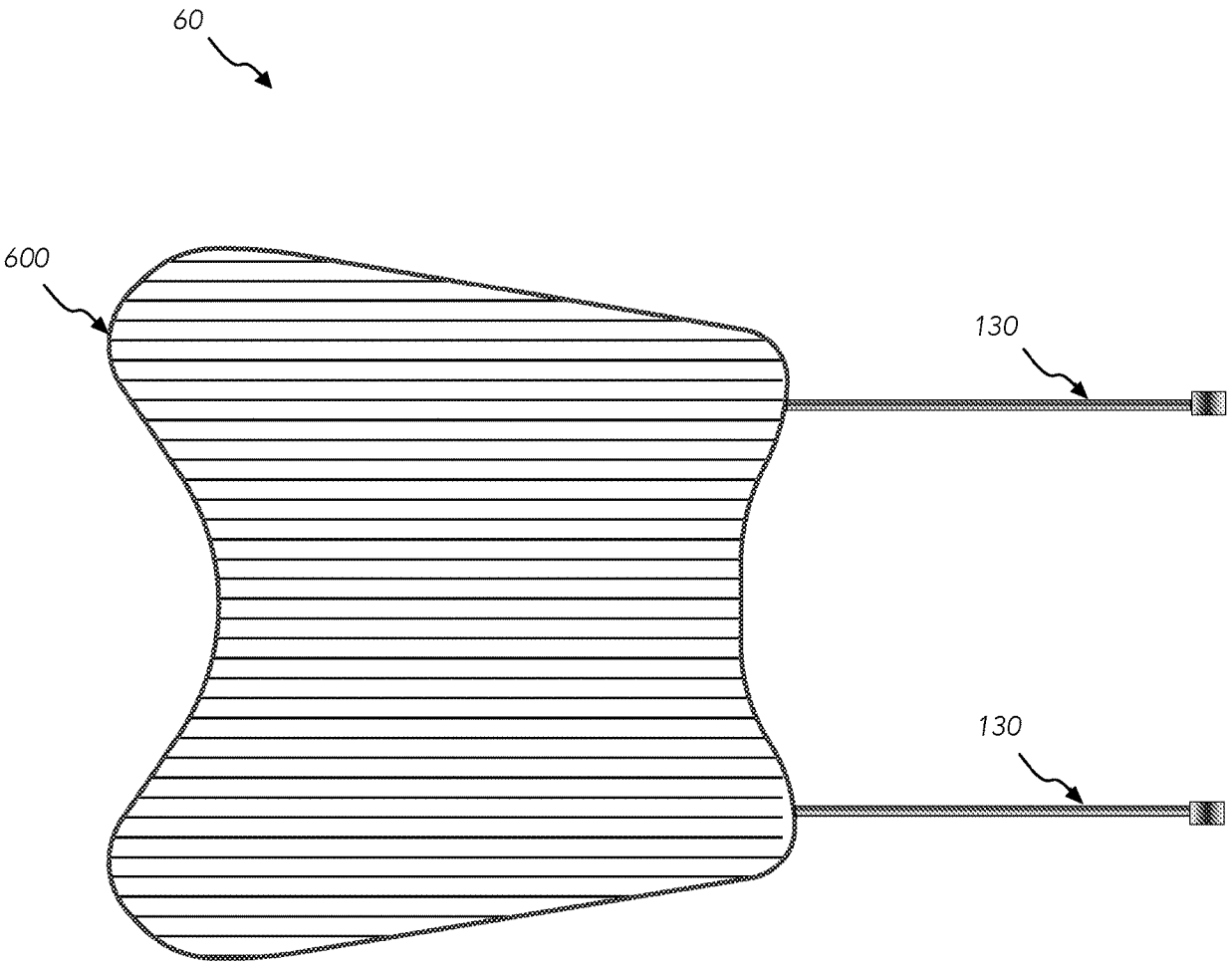
FIGS. 6, 7, and 8 illustrate different example shapes of a fin.
Figure 7:
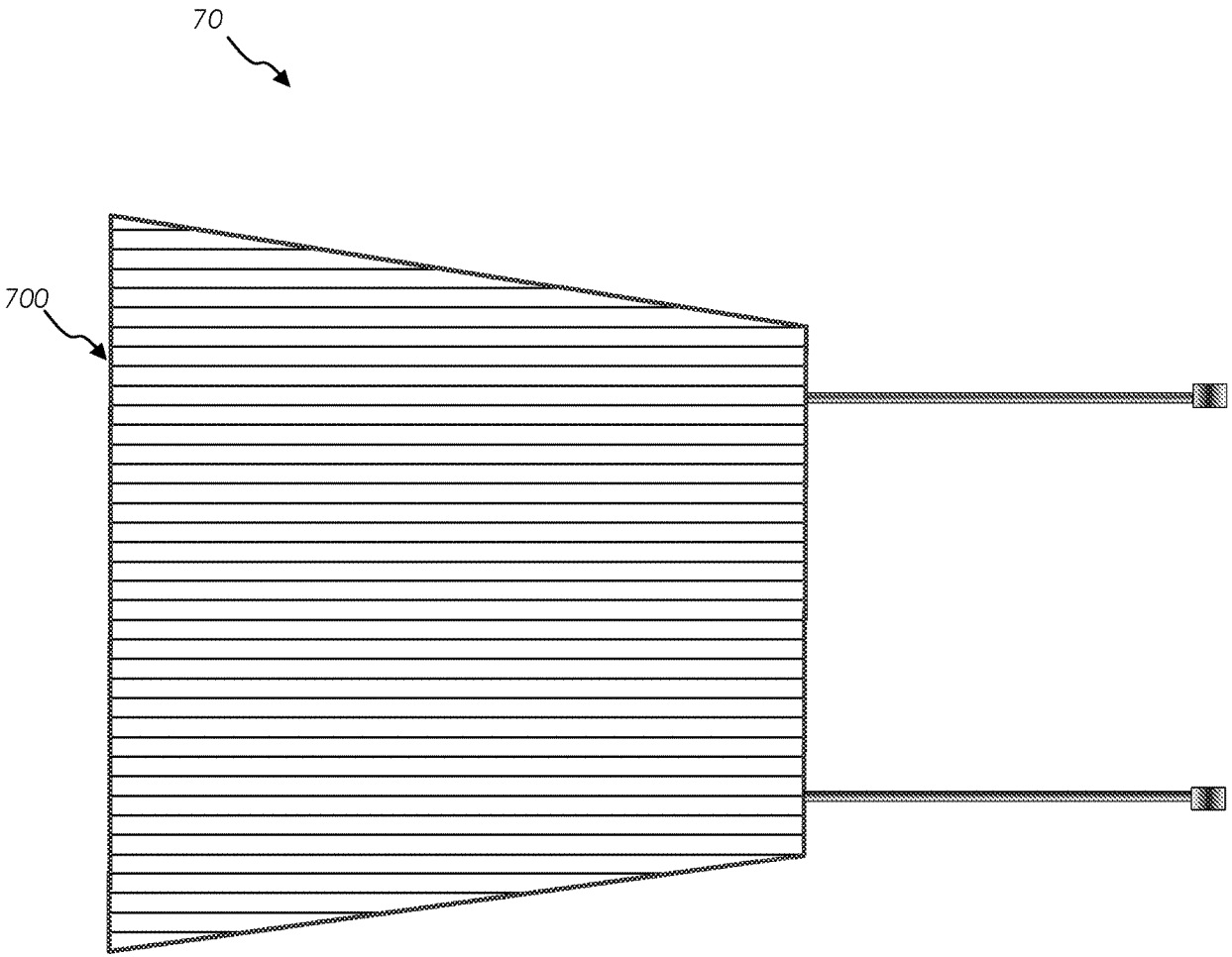
Figure 8:
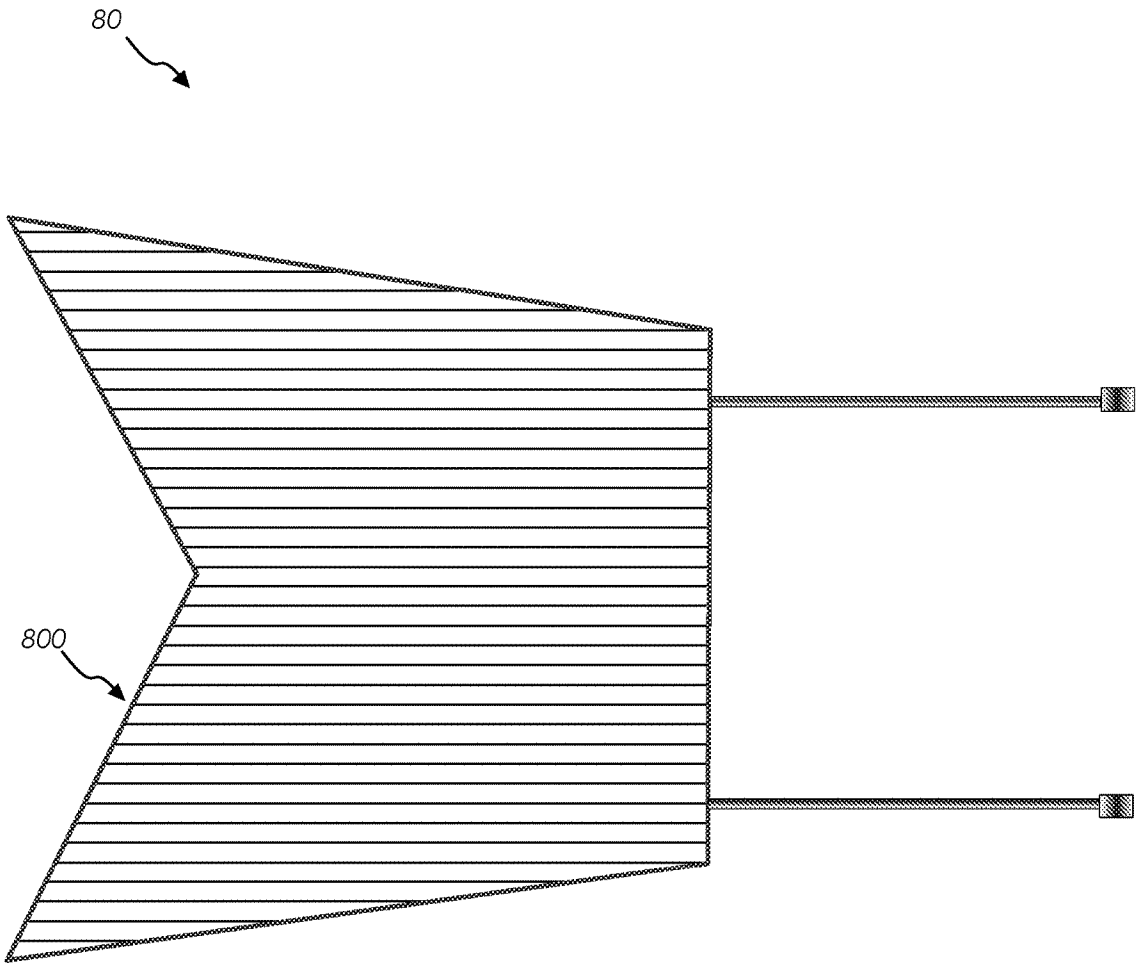

The fin 110 can have different shapes and sizes, and can be flexible or stiffer according to the intended use. For example, a fin 60 can have a fishtail profile 600 as illustrated in FIG. 6. In another embodiment, a fin 70 can be substantially triangular or trapezoidal 700 as illustrated in FIG. 7. In yet another embodiment, the fin 80 can have a V-shape 800 as illustrated in FIG. 8. The fin can be long (e.g., extending over 6" from the toe portion 102) which can be beneficial for recreational swimmers and snorkelers. Alternatively, the fin can be short (e.g., extending 6" or less from the toe portion 102) which can be beneficial for more advanced swimmers and/or those looking to swim quickly.

Figure 9:
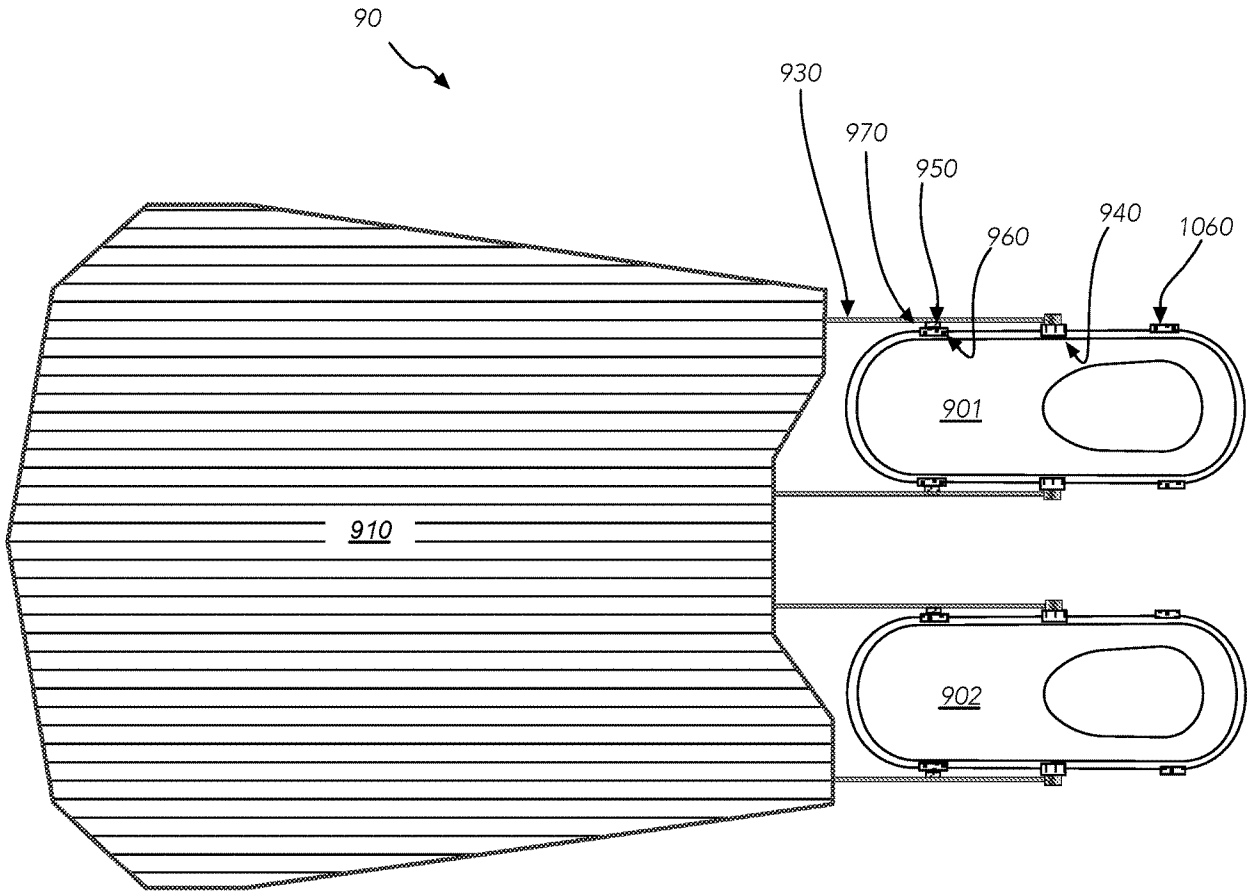
FIG. 9 illustrates a top view of an assembly for water sports in a first configuration according to an alternative embodiment.

FIG. 9 is a top view of an assembly 90 for water sports in a first configuration, which can be used for swimming, snorkeling, water skiing and/or scuba diving according to another embodiment. The apparatus 90 includes first and second boots 901, 902 worn on a user's feet, and a monofin 910. Each boot 901, 902 can be the same as or substantially the same as boot 100 described earlier. One or more connecting rods 930 are attached to each boot 901, 902 and to the monofin 910. The connecting rods 930 are pivotably attached to the boots 901, 902 at pivot points 940 (e.g., using bearings) in the same way as rods 130 and boot 100, discussed above. In addition, each connecting rod 930 includes a solid securement body 950 of a given size and shape that allows securement to and is removably press or friction fit into a corresponding front securement cavity or locking point or points 960 of each boot 901, 902 in a press fit or friction fit assembly 970. There may be one securement body and corresponding locking point on each side of each of the user's feet for a total of four securement/locking mechanisms in the Fin Forward position (using locking points 960 et seq.) and four securement/locking mechanisms in the Fin Backward position (using locking points 1060 et seq.). The connecting rod securement bodies 950 of connecting rods 930 can be released from the front locking point cavities 960, rotated backwards and removably secured in corresponding rear locking points or cavities 1060 such as by press-fitting bodies 950 into rear locking points or cavities 1060.

Figure 10:
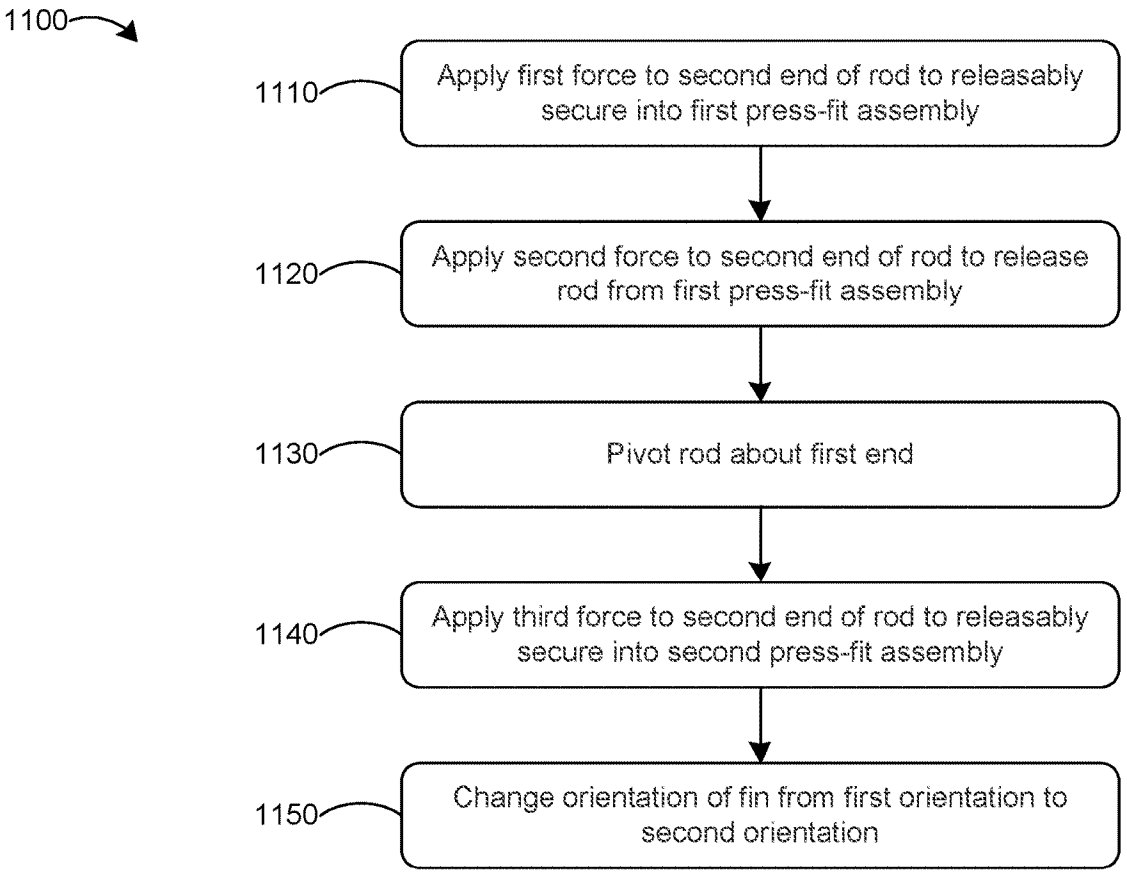
FIG. 10 illustrates a flow chart of a method for configuring an apparatus for water sports.

FIG. 10 is a flow chart 1100 of a method for configuring an apparatus for water sports. The apparatus can be any of the apparatus or assemblies described herein. In step 1110, a first force is applied to a second end of a rod to releasable secure the second end of the rod in a first press-fit assembly disposed at a toe portion on a side of a boot. For example, when the boot's sole is disposed on the ground (e.g., as in normal wear), the first force is applied upwardly (e.g., away from the ground and away from the direction of gravitational pull). The first press-fit assembly can include a securement body disposed on a portion of rod and a cavity defined on the side of the boot (e.g., front cavity 160). The second end of the rod is attached to a fin such that the fin is disposed in front of the boot's toe portion.

In step 1120, a second force is applied downwardly (e.g., towards the ground and toward the direction of gravitational pull) to release the second end of the rod from the first press-fit assembly. The second force is in the opposite direction to the first force.

In step 1130, the rod is pivoted about its first end such that the second end of the rod is disposed proximal to a heel portion on the side of the boot. The second force can be continued to be applied during this step. In the alternative, a rotational force can be applied to the second end of the rod during this step.

In step 1140, a third force is applied to the second end of the rod to releasably secure the second end of the rod in a second press-fit assembly disposed at the heel portion of the boot. The third force is a direction parallel to the direction of the first force.

In step 1150, the orientation of the fin is changed from a first orientation where the fin is disposed adjacent to the toe portion of the boot (e.g., as a result of step 1110) to a second orientation where the fin is disposed adjacent to the heel portion of the boot (e.g., as a result of step 1150).

The invention should not be considered limited to the particular embodiments described above, but rather should be understood to cover all aspects of the invention as fairly set out in the attached claims. Various modifications, equivalent processes, as well as numerous structures to which the invention may be applicable, will be apparent to those skilled in the art to which the invention is directed upon review of this disclosure. The claims are intended to cover such modifications and equivalents.

What is claimed is:

1. An apparatus wearable of a user's feet for water sports, comprising:

a boot having a toe portion and a heel portion;

a fin pivotably attached to the boot, and first and second rods, each rod comprising a first end that is pivotably attached to a respective side of the boot and a second end that is (a) attached to the fin and (b) releasably attached to the respective side of the boot;

wherein:

in a first configuration the fin is oriented towards the toe portion, and in a second configuration the fin is oriented towards the heel portion;

wherein the fin is releasably secured in the first and second configurations;

wherein:

a first cavity is defined at the toe portion on each side of the boot, the second end of each rod includes a body, and each first cavity is configured to releasably secure the body to place the apparatus in the first configuration; and wherein:

a second cavity is defined at the heel portion on each side of the boot, and each second cavity is configured to releasably secure the body to place the apparatus in the second configuration.

2. The apparatus of claim 1, wherein the first end of each rod is coupled to a bearing.

3. A method of configuring a wearable apparatus for water sports, comprising:

applying a first force to a second end of a rod to releasably secure the second end of a rod in a first press-fit assembly disposed at a toe portion on a side of a boot, the second end attached to a fin;

applying a second force to the second end of the rod to release the second end of the rod from the first press-fit assembly, the second force in an opposite direction to the first force;

pivoting the rod about a first end of the rod such that the second end of the rod is disposed proximal to a heel portion on the side of the boot;

applying a third force to the second end of the rod to releasably secure the second end of the rod in a second press-fit assembly disposed at the heel portion; and changing an orientation of the fin from a first orientation where the fin is oriented towards the toe portion of the boot to a second orientation where the fin is oriented towards the heel portion of the boot.

4. The method of claim 3, wherein the first press-fit assembly comprises a body disposed on the second end of the rod and a first cavity defined in the toe portion on the side of the boot.

5. The method of claim 4, wherein the second press-fit assembly comprises the body a second cavity defined in the heel portion on the side of the boot.

* * * * *